US006042410A

United States Patent [19]

Watanabe

[11] Patent Number: 6,042,410

[45] Date of Patent: Mar. 28, 2000

[54] INSERT-FORCE-FREE CONNECTOR

[75] Inventor: Hiroshi Watanabe, Shizuoka, Japan

[73] Assignee: Yazaki Corporation, Tokyo, Japan

[21] Appl. No.: 09/063,441

[22] Filed: Apr. 21, 1998

[30] Foreign Application Priority Data

Apr. 23, 1997 [JP] Japan ..... 9-105857

[51] Int. Cl.[7] ..... H01R 13/629

[52] U.S. Cl. ..... 439/269.1; 439/260

[58] Field of Search ..... 439/260, 261, 439/263, 265, 269.1, 70

[56] References Cited

U.S. PATENT DOCUMENTS

| | | | |
|---|---|---|---|
| 4,749,362 | 6/1988 | Hoffman et al. | 439/269.1 |
| 4,904,197 | 2/1990 | Cabourne | 439/260 |
| 5,489,216 | 2/1996 | Matsushita et al. | 439/260 |
| 5,788,524 | 8/1998 | Balyasny et al. | 439/269.1 |
| 5,795,171 | 8/1998 | Bernardini | 439/260 |

FOREIGN PATENT DOCUMENTS

| | | |
|---|---|---|
| 63-218175 | 9/1988 | Japan . |
| 4-319271 | 11/1992 | Japan . |
| 7-169529 | 7/1995 | Japan . |
| 8-37066 | 2/1996 | Japan . |

*Primary Examiner*—Hien Vu

*Attorney, Agent, or Firm*—Armstrong, Westerman, Hattori, McLeland and Naughton

[57] ABSTRACT

An insert-force-free connector in which very little inserting force is required between the connectors is provided. This insert-force-free connector includes a hinged connector having at least two housings movably connected by hinges keeping a predetermined distance between the housings. The electric contact portions of terminals held in the housings are provided inside the housings. The insert-force-free connector also includes a block connector as a mating connector for the hinged connector having a block-like housing. The electric contact portions of the terminals held in the block-like housing are provided outside the block-like housing. The block connector is inserted into the hinged connector and, upon closing the terminals of both connectors are connected.

8 Claims, 7 Drawing Sheets

INSERT-FORCE-FREE CONNECTOR

BACKGROUND OF THE INVENTION

1. Field of the Invention

The present invention relates to an insert-force-free connector for connecting wire harnesses and the like, and more particularly, to an insert-force-free connector in which very little inserting force is caused between the connectors.

2. Related Art

FIG. 6 is a perspective view of a conventional connector which is made up of a male connector a provided with female terminals and a female connector b having male terminals protruding inside a receiving portion c into which the male connector a is inserted.

With such a conventional connector, however, there has been a problem that as the number of terminals increases (i.e., multi-polarization), the inserting force between the male and female connectors increases, making the engagement of both connectors more difficult.

To reduce the inserting force between multi-polarized connectors, insert-force-free connectors shown in FIGS. 7 and 8 have been suggested.

The insert-force-free connector shown in FIG. 7 is made up of a male connector 110 provided with a lever 111 at the upper end of the housing, a female connector 120 which stands in the center of a receiving portion 120*a* having a following shaft 121 connected to the lever 111 penetrating the housing of the male connector 10 (Japanese Patent Application Laid-Open No. 4-319271).

With such a structure, even if the number of terminals increases, the male connector 110 can be inserted into the receiving portion 120*a* of the female connector 120 with only a small force by rotating the lever 111 through an angle of 180°.

The insert-force-free connector shown in FIG. 8 is made up of a male connector 210 having cam protrusions 211 protruding from one of the side surfaces, a female connector 220 for accommodating the male connector 210, and a slider 230 to be inserted into the female connector 220 through insertion holes 221 for inserting the male connector 210 into the female connector 220. The slider 230 is provided with cam grooves 231 for guiding the cam protrusions 211 (Japanese Patent Application Laid-Open No. 7-169529).

By virtue of the cam protrusions 211 and the cam grooves 231, the male connector 210 can be inserted into the receiving portion 220*a* of the female connector 220 just by pushing the slider 230 into the female connector 220 with only a small force.

With the above two conventional insert-force-free connectors, however, there has been a problem in that friction is inevitably caused by the sliding movements of the male connectors 110 and 210 along the side walls of the receiving portions 120*a* and 220*a* (or the slider 230, to be exact).

The male connectors 110 and 210 and the female connectors 120 and 220 are provided with female terminals and male terminals, respectively, and electric connection is conducted by inserting the male terminals into the female terminals. Thus, an inserting force is also inevitably caused between the male and female terminals.

With the conventional insert-force-free connectors, the frictional force caused when inserting the male connectors 110 and 210 into the receiving potions 120*a* and 220*a,* and the inserting force caused between the terminals of the male connectors 110 and 210, and the female connectors 120 and 220, can be reduced by use of the lever 111 and the slider 230. However, such a frictional force and inserting force cannot be eliminated, leaving much room for improvement in conventional insert-force-free connectors.

SUMMARY OF THE INVENTION

The principal object of the present invention is to provide an insert-force-free connector in which little inserting force is caused between connectors.

To achieve the above object, an insert-force-free connector according to a first aspect of the present invention includes: a hinged connector having at least two housings movably connected to each other by hinges keeping a predetermined distance between them, with the electric contacts of the terminals being situated inside the housing; and a block connector having a block-like housing, with the electric contacts of the terminals being situated outside the housing. The block connector is inserted into the hinged connector when it is closed, thereby connecting the terminals of both connectors.

In such a structure, the connectors can be connected without insertion or engagement, and the frictional force caused at the receiving portions at the time of male connector insertion can be eliminated.

In a second aspect of the present invention, first inclined surfaces which incline toward the center of the housing are formed at the tip of the housing of the block connector, whereas second inclined surfaces corresponding to the first inclined surfaces are formed inside the housings of the hinged connector. By inserting the block connector into the hinged connector when it is open, the first inclined surfaces slide along the second inclined surfaces, thereby sandwiching the block connector by the closed hinged connector.

With such a structure, both connectors can be easily connected, because the housings of the hinged connector are guided by the inclined surfaces.

As the inclined surfaces of both connectors match each other, they come into contact with each other at the time of connecting both connectors. Thus, the block connector is secured inside the hinged connector.

Although the inclined surface of both connectors slide along each other at the time of connecting them, no large frictional force will result.

As the block connector is inserted into the hinged connector, the housings of the hinged connector are closed. Thus, no large frictional force will be caused between the inclined surfaces of both connectors.

In a third aspect of the present invention, the electric contact portions of the terminals held in both connectors are electric contacts requiring no engagement.

With such a structure, both connectors can be electrically connected by virtue of the electric contacts, preventing frictional force between the terminals at the time of connection.

Coupled with the effects of the first aspect of the present invention, the cause of frictional force and inserting force between both connectors can be eliminated so as to obtain a connector which causes very little frictional force and inserting force.

In a fourth aspect of the present invention, the hinged connector and the block connector are provided with locking portions by which the block connector is locked into the hinged connector in a closed state. More specifically, each of the locking portions is made up of locking claws formed on either the hinged connector or on the block connector, and locking frames formed on either the hinged connector or on the block connector, whichever is not provided with the locking claws.

With such a structure, the connection between the hinged connector can be surely maintained.

In the case where the locking mechanism of the hinged connector is provided for a module or the like in which the low insertion module of the present invention is employed, or where conventional male and female terminals are used, the connection between the hinged connector and the block connector can be maintained without the locking portions described above.

The above and other objects and features of the present invention will be more apparent from the following description taken in conjunction with the accompanying drawings.

DETAILED DESCRIPTION OF THE PREFERRED EMBODIMENTS

The following is a description of the preferred embodiments of an insert-force-free connector of the present invention, with reference to the accompanying drawings.

Figures 1A, 1B:
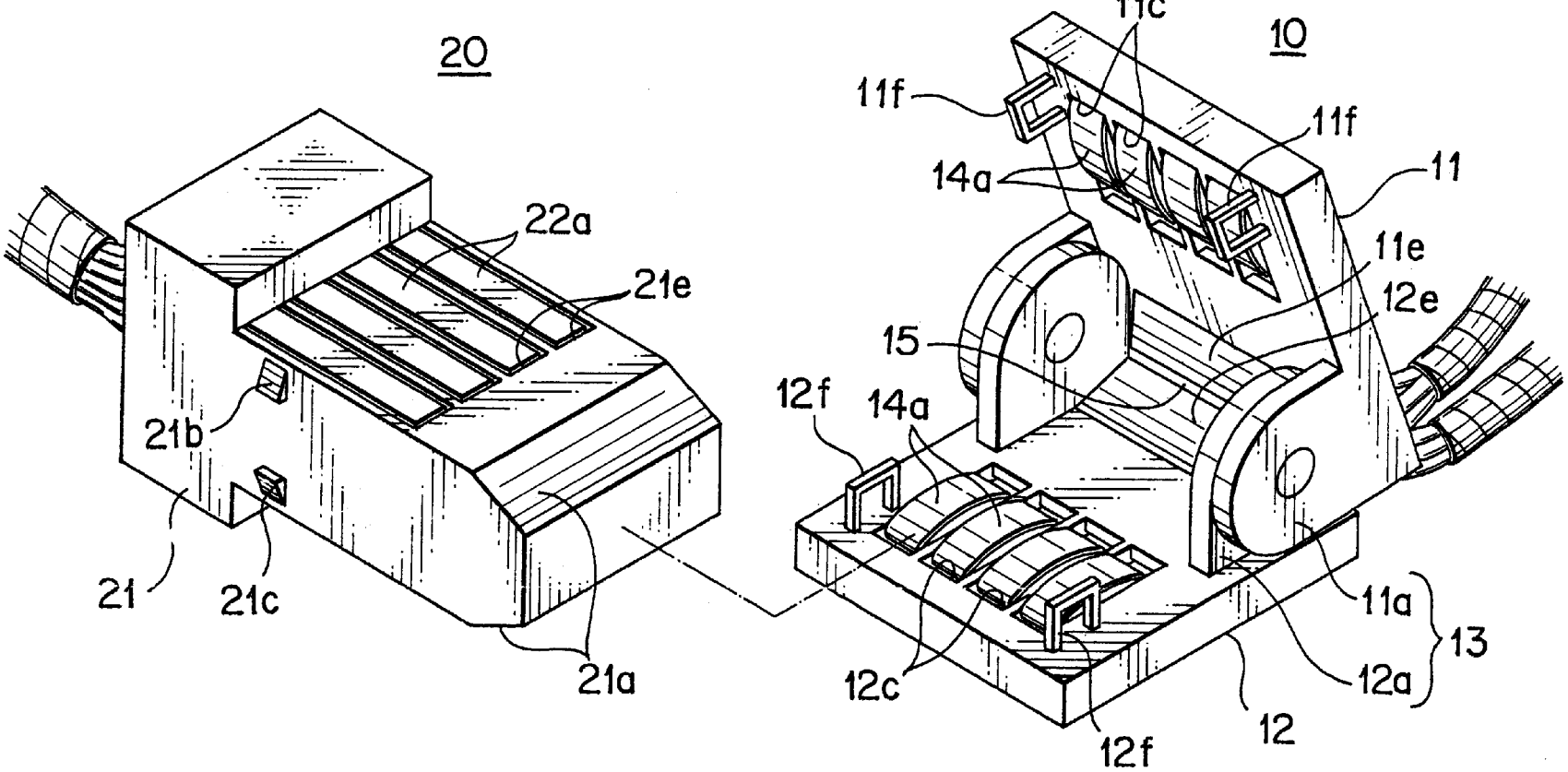
FIG. 1A is a perspective view of a block connector which constitutes an insert-force-free connector in accordance with the present invention.
FIG. 1B is a perspective view of a hinged connector which constitutes the insert-force-free connector in accordance with the present invention.
Figure 2A:
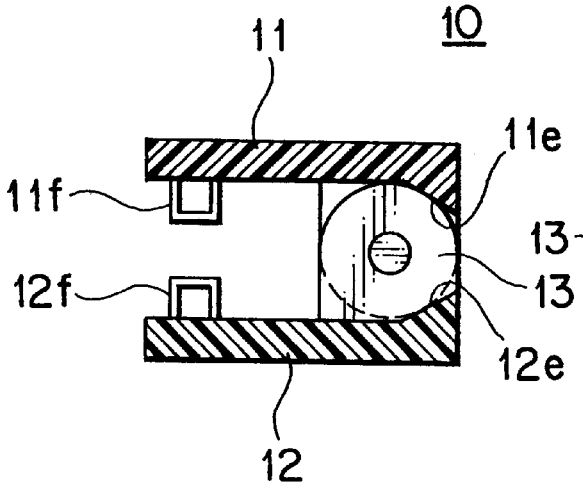
FIG. 2A is a sectional side view of the hinged connector when it is closed.
Figure 2B:
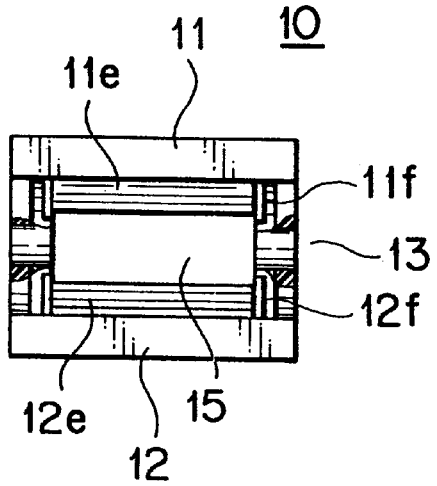
FIG. 2B is a front view of the hinged connector when it is closed.
Figure 2C:
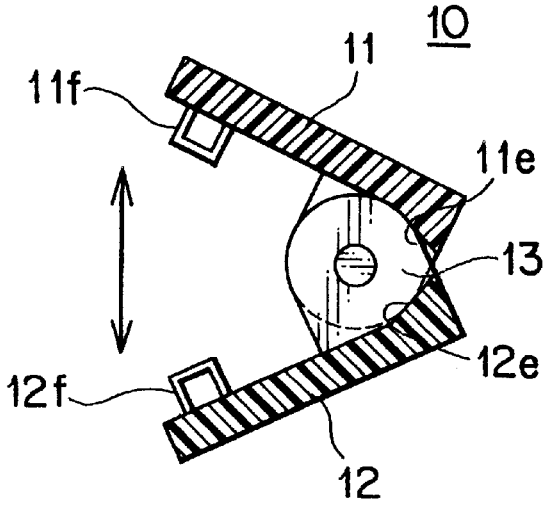
FIG. 2C is a sectional side view of the hinged connector when it is open.
Figure 2D:
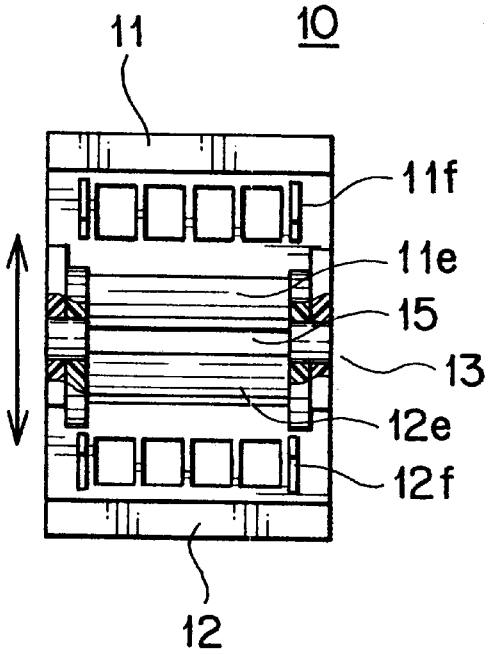
FIG. 2D is a front view of the hinged connector when it is open.
Figure 3A:
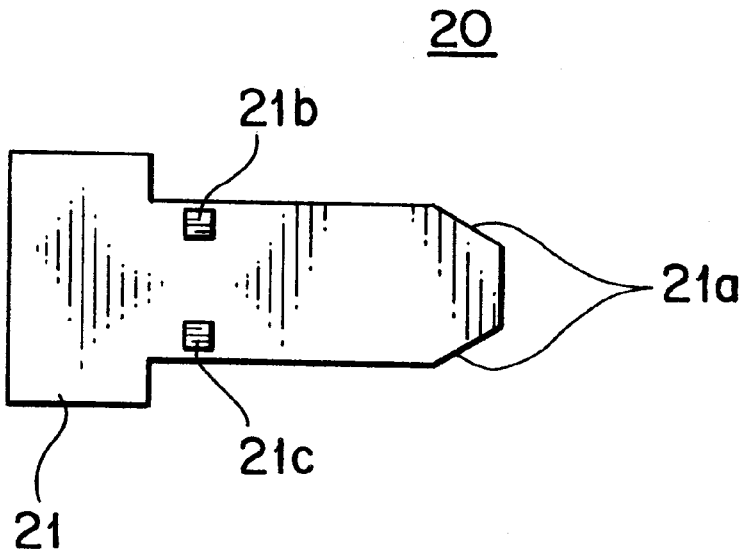
FIG. 3A is a side view of the block connector.
Figure 3B:
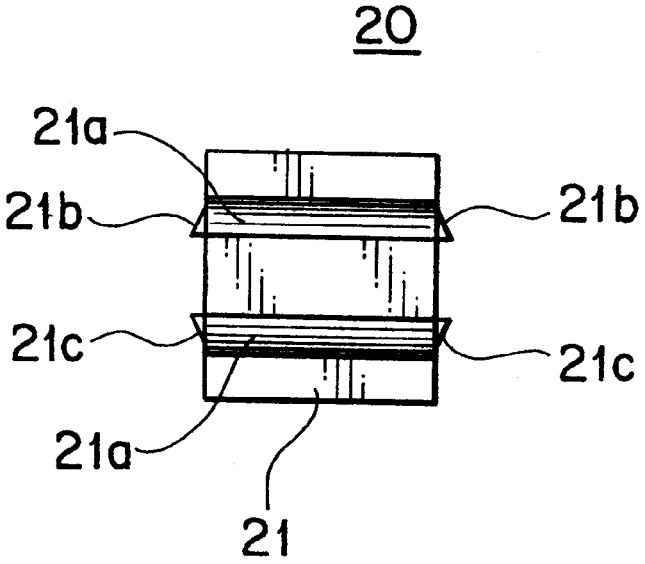
FIG. 3B is a front view of the block connector.
Figure 4:
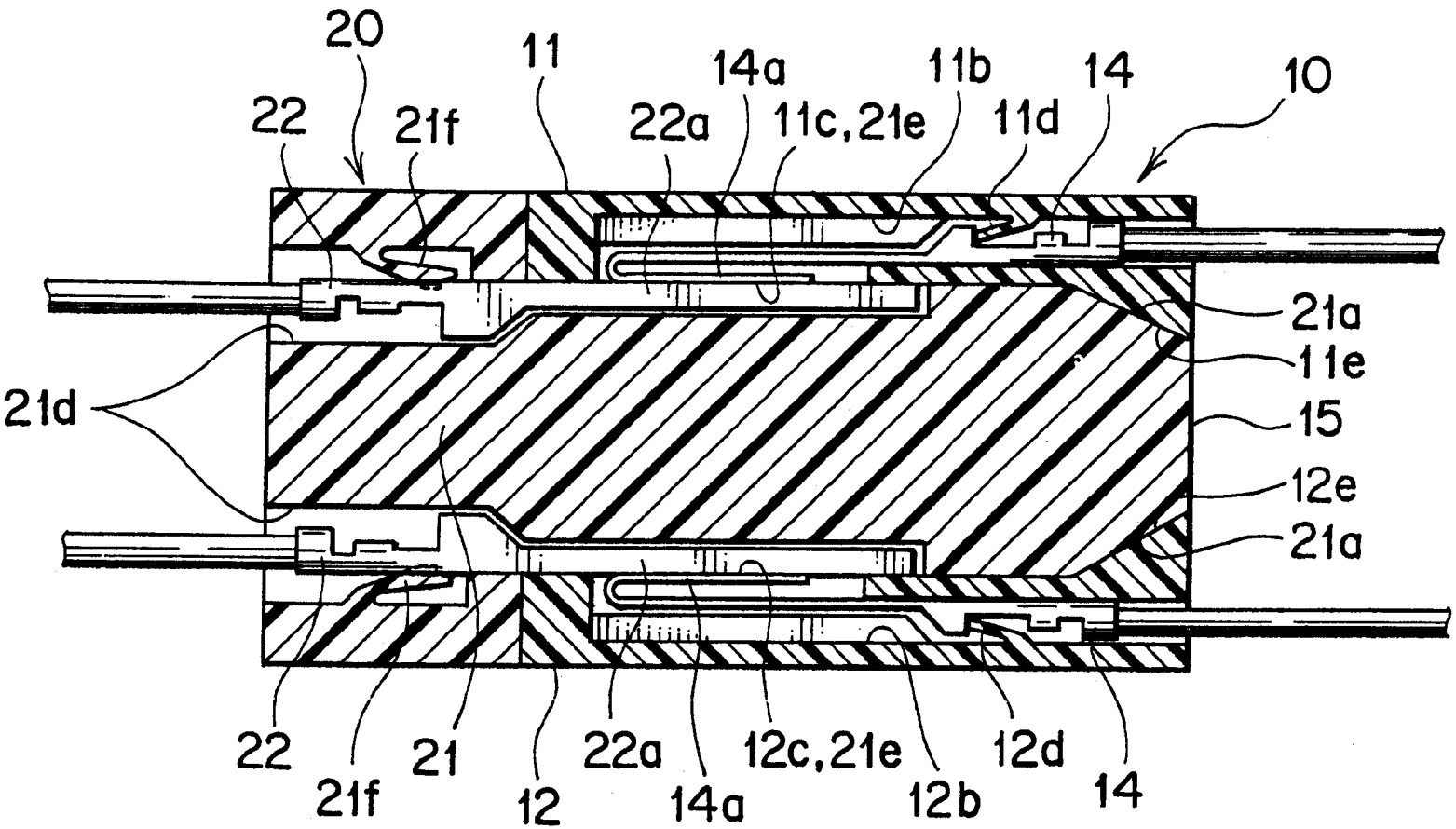
FIG. 4 is a sectional side view illustrating how the hinged connector is connected to the block connector.

In FIGS. 1A and 1B, the insert-force-free connector of this embodiment comprises a hinged connector 10 and a block connector 20.

The hinged connector 10 includes a pair of flat housings 11 and 12 which are movably connected to each other by hinges 13 keeping a predetermined distance between them, as shown in FIGS. 1A, 2A to 2D, and 4.

The flat housings 11 and 12 have the same structures except for the position of bearings 11*a* and 12*a* which constitute the hinges 13. The flat housings 11 and 12 include terminal receiving chambers 11*b* and 12*b,* terminal windows 11*c* and 12*c* leading to the terminal receiving chambers 11*b* and 12*b,* and holding arms 11*d* and 12*d* protruding from the inside of the terminal receiving chambers 11*b* and 12*b*.

The terminal receiving chambers 11*b* and 12*b* accommodate terminals 14 which are held by the holding arms 11*d* and 12*d,* respectively.

Each of the terminals 14 has its tip portion as a plate-like elastic electric contact 14*a* which is exposed to the outside of the flat housings 11 and 12 through the terminal windows 11*c* and 12*c,* respectively.

Inclined surfaces 11*e* and 12*e* corresponding to inclined surfaces 21*a* at the tip of the block connector 20 are formed outside the flat housings 11 and 12. The flat housings 11 and 12, facing to each other at a predetermined distance, form a rectangular opening 15 of the same size as the tip surface of the block connector 20 at the ends of the inclined surfaces 11*e* and 12*e*.

When the flat housings 11 and 12 are closed, the inclined surfaces 11*e* and 12*e* and the opening 15 form a space of the same shape as the tip portion of the block connector 20.

The flat housings 11 and 12 are provided with two pairs of locking frames 11*f* and 12*f* protruding from the opposite side from the hinges. The locking frames 11*f* and 12*f* constitute locking portions with the block connector 20.

As shown in FIGS. 1A, 3A, 3B, and 4, the block connector 20 is provided with the inclined surfaces 21*a* that are inclined toward the center of a block-like housing 21.

Two pairs of locking claws 21*b* and 21*c* protrude from both side walls of the housing 21. These locking claws 21*b* and 21*c* and the locking frames 11*f* and 12*f* constitute the locking portions.

The housing 21 includes two vertically-symmetrical terminal receiving chambers 21*d,* terminal windows 21*e* leading to the terminal receiving chambers 21*d,* and holding arms 21*f* protruding inside the terminal receiving chambers 21*d*.

The terminal receiving chambers 21*d* accommodate terminals 22 held by the holding arms 21*f*.

The ends of the terminals 22 form electric contacts 22*a* having flat contact surfaces. The electric contacts 22*a* are exposed to the outside of the housing 21 through the terminal windows 21*e*.

Figure 5A:
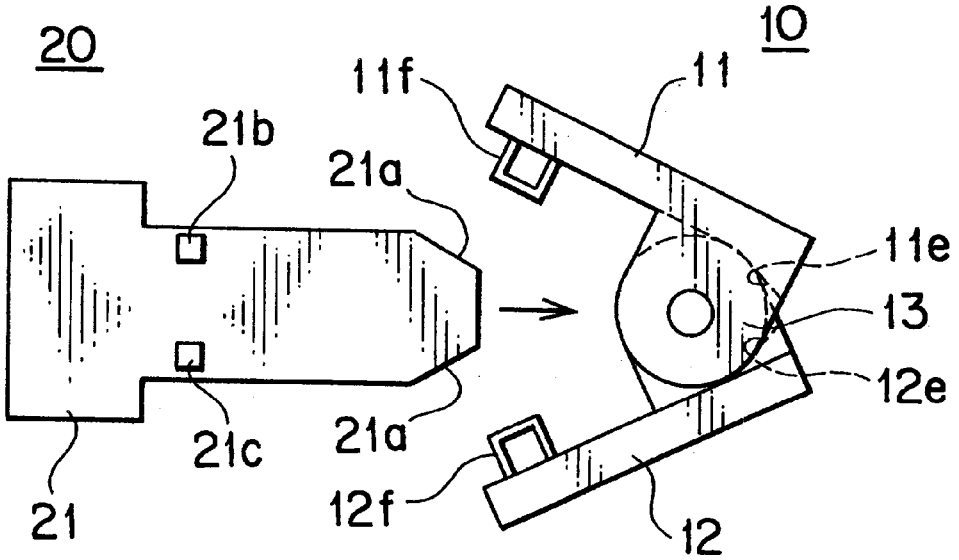
FIGS. 5A and 5B illustrate the operation of connecting the hinged connector to the block connector.

When the hinged connector 10 and the block connector 20 described above are connected, the flat housings 11 and 12 of the hinged connector 10 is opened, as shown in FIG. 5A, and the block connector 20 is then inserted between the flat housings 11 and 12.

Figure 5B:
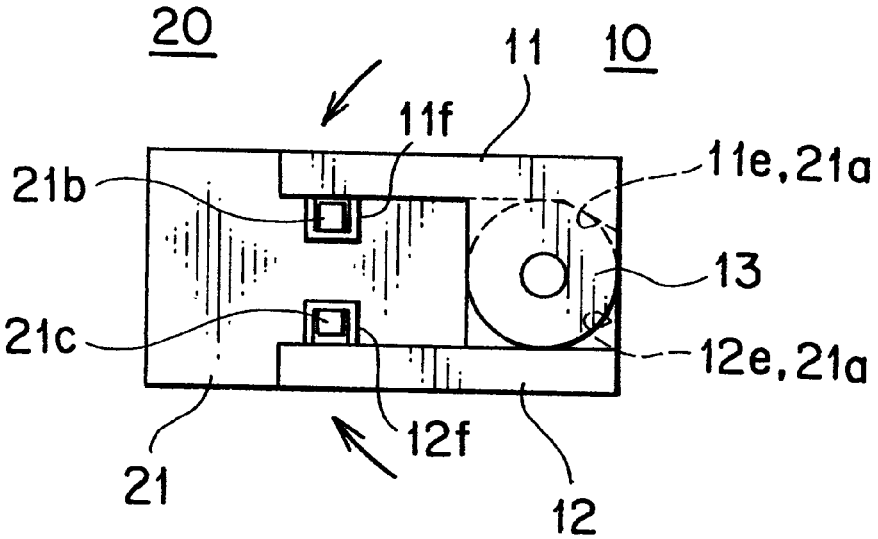
Figure 6:
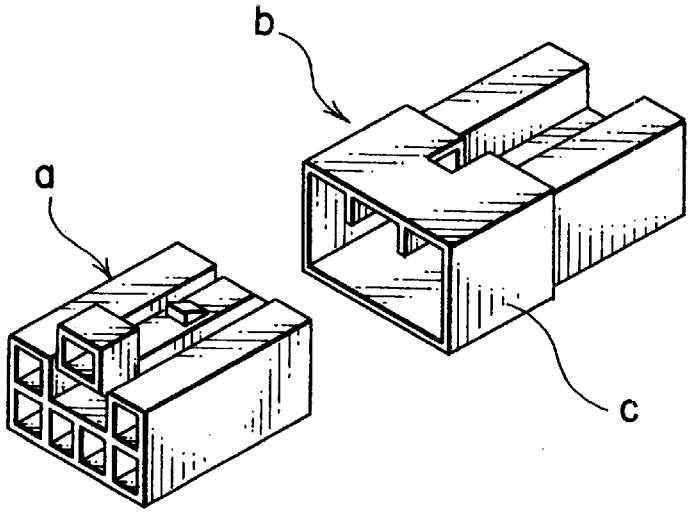
FIG. 6 PRIOR ART
FIG. 6 is a perspective view of a conventional connector in the prior art.
Figure 8:
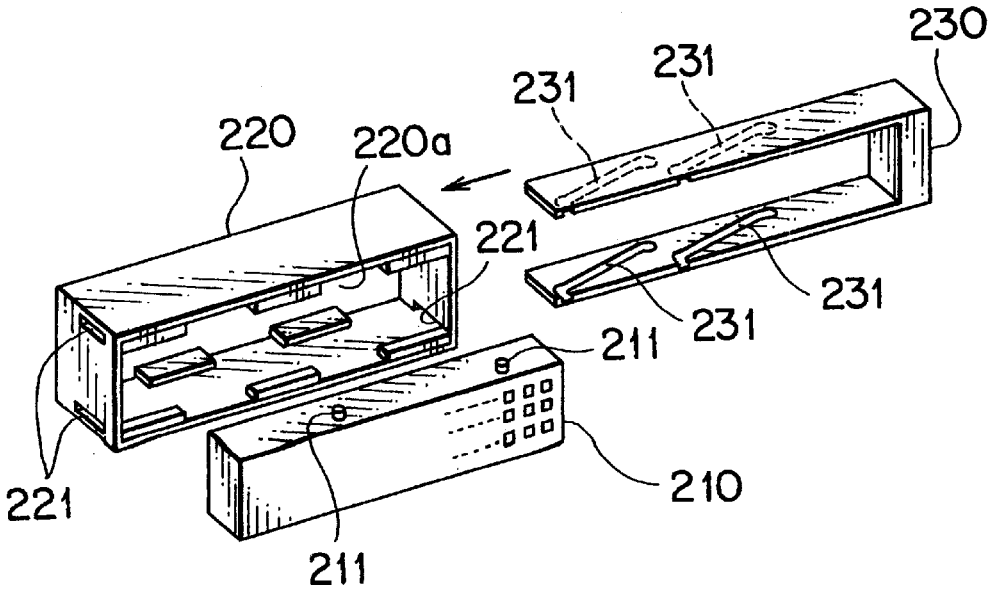
FIG. 8 PRIOR ART
FIG. 8 is a perspective view of a conventional insert-force-free connector using a slider.
Figure 7:
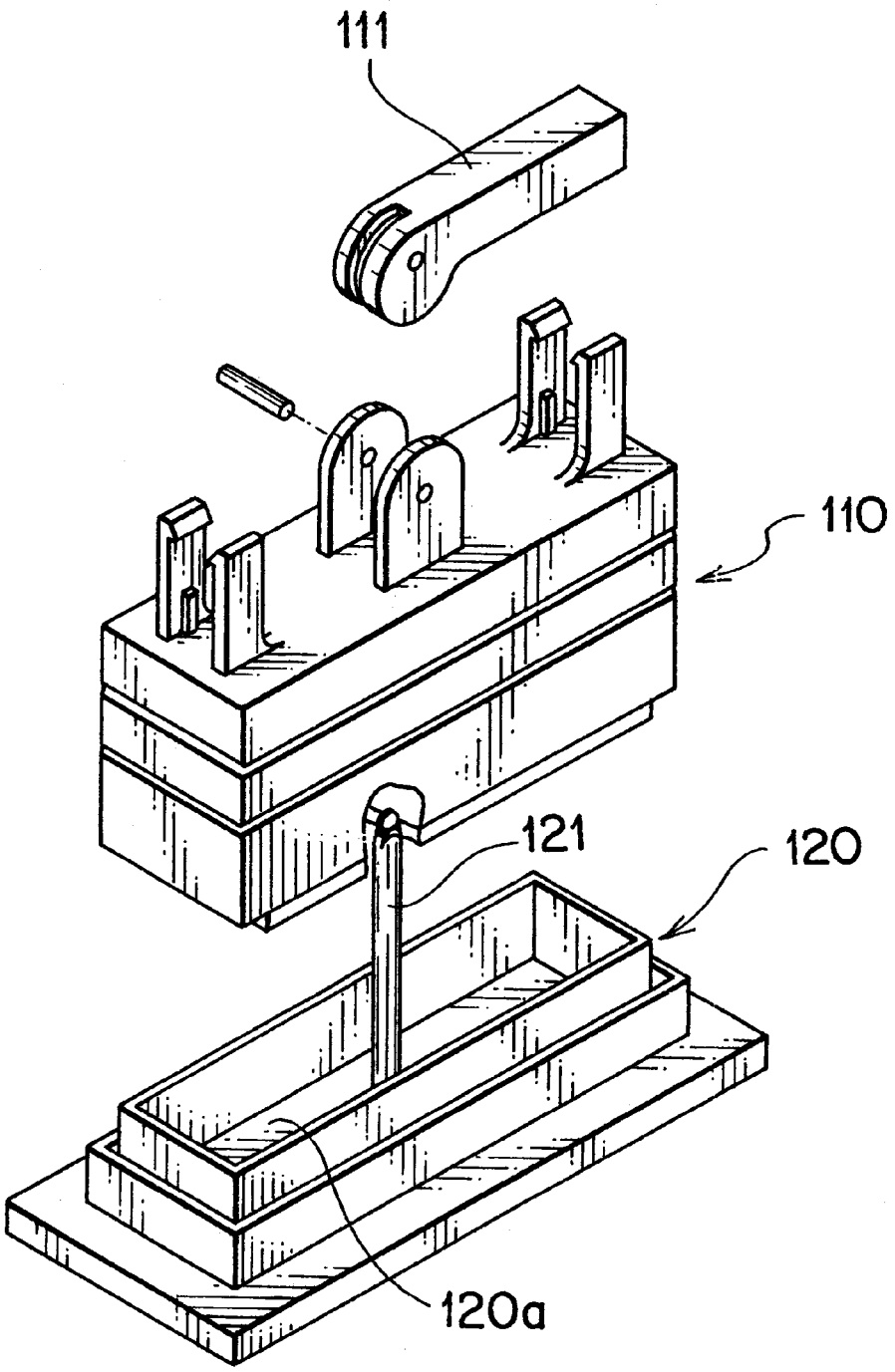
FIG. 7 PRIOR ART
FIG. 7 is a perspective view of a conventional insert-force-free connector using a lever.

As shown in FIG. 5B, the inclined surfaces 21*a* at the end of the block connector 20 slide on the inclined surfaces 11*e* and 12*e,* and the flat housings 11 and 12 are closed to sandwich the block connector 20 therebetween. Thus, the electric contacts 14*a* of the flat housings 11 and 12 are brought into contact with the respective electric contacts 22*a* of the block connector 20, thereby electrically connecting the hinged connector 10 and the block connector 20.

Here, the locking frames 11*f* and 12*f* are engaged with the locking claws 21*b* and 21*c* of the block connector 20. Thus, the connection between the hinged connector 10 and the block connector 20 can be maintained.

With such an insert-force-free connector of this embodiment, the connectors 10 and 20 can be connected without insertion or engagement, avoiding friction caused in a conventional insert-force-free connector when inserting a male connector into a receiving end.

The connectors 10 and 20 can also be electrically connected by virtue of the electric contacts 14*a* and 22*a,* thereby preventing an inserting force from being caused to a conventional insert-force-free connector at the time of terminal connection.

Thus, structural factors to causing friction and inserting force between the connectors 10 and 20 can be eliminated, and a connector in which very little inserting force is caused can be obtained.

Since the hinged connector 10 is provided with the inclined surfaces 11*e* and 12*e* whereas the block connector 20 is provided with the inclined surfaces 21*a,* the flat housings 11 and 12 of the hinged connector 10 are guided along the inclined surfaces 21*a* and then closed just by inserting the block connector 20 into the hinged connector 10 when it is open. Thus, the connectors 10 and 20 can be easily connected.

At the time of connecting the connectors 10 and 20, the inclined surfaces 11*e,* 12*e,* and 21*a* match each other so as to position the block connector 20 inside the open and close connector 10.

Although the inclined surfaces 11*e,* 12*e,* and 21*a* are brought into contact and move against each other at the time of connecting the connectors 10 and 20, this does not cause any great frictional force.

As the block connector 20 is inserted, the flat housings 11 and 12 of the hinged connector 10 are moved in a closing direction. Accordingly, no great frictional force is caused between the inclined surfaces 11*e,* 12*e,* and 21*a,* which are the contact surfaces between both connectors 10 and 20.

It should be noted that the insert-force-free connector of the present invention is not limited to the above embodiment.

Although the hinged connector 10 is made up of two flat housings 11 and 12 in the above embodiment, it can also be made up of four housings which are movably connected to each other. In such a case, the inner side surfaces of the four housings serve as the connecting portion for the terminals, whereas the side surfaces of the block connector 20 serve as the connecting portion for the terminals. Thus, the connector can easily be multi-polarized.

In the case where a module in which the insert-force-free connector is employed is provided with a locking mechanism or where conventional male terminals are used, the connection between the hinged connector and the block connector 20 can be maintained without the locking frames 11*f* and 12*f,* and the locking claws 21*b* and 21*c*.

As described so far, with the insert-force-free connector of the present invention, the hinged connector and the block connector can be connected without insertion or engagement so as to avoid frictional force which is often caused in the conventional insert-force-free connector when inserting the male connector into the receiving portion.

By virtue of the electric contacts, the hinged connector and the block connector can be electrically connected, thereby preventing frictional force which is often caused in the conventional insert-force-free connector at the time of terminal connection.

Thus, causes of the frictional force and inserting force between the hinged connector and the block connector can be eliminated to obtain a connector in which very little inserting force results.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An insert-force-free connector comprising:

a hinged connector having at least two housings movably connected to each other by hinges keeping a predetermined distance between the housings to form an opening, electric contacts of terminals held in the housings being exposed to the inside of said housings; and a block connector serving as a mating connector for said hinged connector and having a block-like housing, said block-like housing having a tip portion fitted to said opening of said hinged connector, electric contacts of terminals held in the block-like housing being exposed to the outside of said block-like housing; wherein the block connector is inserted into the hinged connector, thereby bringing the electric contacts of the terminals into contact with each other so as to connect the terminals of the hinged connector and the block connector, and further wherein the block connector is provided at the tip portion of the block-like housing with first inclined surfaces inclining toward the center of the housing, and second inclined surfaces corresponding to the first inclined surfaces are formed inside the housings of the hinged connector.

2. The insert-force-free connector according to claim 1, wherein each of the housings of the hinged connector comprises:

a terminal receiving chamber;

a terminal window leading to the terminal receiving chamber; and a holding arm for holding the terminal in the terminal receiving chamber.

3. The insert-force-free connector according to claim 1, wherein the housing of the block connector comprises: terminal receiving chambers in upper and lower rows; terminal windows leading to the respective terminal receiving chambers; and holding arms for holding the terminals in the respective terminal receiving chambers.

4. The insert-force-free connector according to claim 1, wherein the first and second inclined surfaces slide along each other so that the hinged connector is pushed to be closed so as to sandwich the block connector therebetween.

5. The insert-force-free connector according to claim 4, wherein the second inclined surfaces form the opening of the same size as the tip portion of the block connector.

6. The insert-force-free connector according to claim 1, wherein said electric contacts of the terminals held in the hinged connector and the block connector are formed by electric contacts which require no engagement.

7. The insert-force-free connector according to claim 1, wherein the hinged connector and the block connector are provided with a locking unit which locks the hinged connector, in a closed state, with the block connector inserted therein.

8. The insert-force-free connector according to claim 7, wherein the locking unit comprises locking claws formed on the block connector, and locking frames formed on the hinged connector.

* * * * *